US012420149B2

(12) United States Patent
Mizutani et al.

(10) Patent No.: US 12,420,149 B2
(45) Date of Patent: Sep. 23, 2025

(54) GOLF CLUB HEAD

(71) Applicant: Sumitomo Rubber Industries, Ltd., Kobe (JP)

(72) Inventors: Naruhiro Mizutani, Kobe (JP); Jun Kodaka, Kobe (JP); Kiyofumi Matsunaga, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 909 days.

(21) Appl. No.: 17/583,595

(22) Filed: Jan. 25, 2022

(65) Prior Publication Data

US 2022/0233921 A1 Jul. 28, 2022

(30) Foreign Application Priority Data

Jan. 26, 2021 (JP) ..... 2021-010666

(51) Int. Cl.
*A63B 53/04* (2015.01)

(52) U.S. Cl.
CPC ..... *A63B 53/0433* (2020.08); *A63B 53/0408* (2020.08); *A63B 53/0416* (2020.08)

(58) Field of Classification Search
CPC ..... A63B 53/0408; A63B 53/0433; A63B 53/0445; A63B 53/0458; A63B 53/0462; A63B 53/0466
USPC ..... 473/313, 324, 330, 332, 345, 349, 350
See application file for complete search history.

(56) References Cited

U.S. PATENT DOCUMENTS 2,550,846 A * 5/1951 Milligan ..... A63B 53/047 473/327
4,332,388 A * 6/1982 Crow ..... A63B 60/00 473/328
5,643,107 A * 7/1997 Gorman ..... A63B 60/00 473/328
5,888,148 A * 3/1999 Allen ..... A63B 60/00 473/290
6,530,847 B1 * 3/2003 Antonious ..... A63B 60/00 473/345
6,780,121 B2 * 8/2004 Herber ..... A63B 53/0466 473/328
6,887,165 B2 * 5/2005 Tsurumaki ..... A63B 53/0466 473/344

(Continued)

FOREIGN PATENT DOCUMENTS

JP 2004-313762 A 11/2004
JP 2016-47183 A 4/2016

*Primary Examiner* — Joseph B Baldori
(74) *Attorney, Agent, or Firm* — Birch, Stewart, Kolasch & Birch, LLP

(57) ABSTRACT

A golf club head includes a face portion that forms a striking face, a crown portion, a sole portion, and a hosel portion. The striking face has a face center. The sole portion includes a toe protruding portion that is a protruding portion provided on a toe side with respect to the face center and is hollow. The toe protruding portion is not present on a heel side with respect to the face center. The toe protruding portion is formed so as to be continuous with the face portion. The height of the toe protruding portion at its apex may be greater than or equal to 1.5 mm and less than or equal to 8 mm. The golf club head is excellent in rebound performance. In the golf club head, the rebound performance can be improved by deformation of the toe protruding portion at impact.

14 Claims, 12 Drawing Sheets

(56) References Cited

U.S. PATENT DOCUMENTS

| | | | | |
|---|---|---|---|---|
| 7,815,524 | B2 * | 10/2010 | Bamber | A63B 60/02 473/291 |
| 8,932,149 | B2 * | 1/2015 | Oldknow | A63B 53/0466 473/328 |
| 9,168,435 | B1 * | 10/2015 | Boggs | A63B 53/04 |
| 9,393,464 | B2 * | 7/2016 | Iwata | A63B 53/04 |
| 9,526,954 | B2 * | 12/2016 | Oldknow | A63B 60/52 |
| 10,245,474 | B2 * | 4/2019 | Boggs | A63B 53/04 |
| 10,751,583 | B1 * | 8/2020 | Suk | A63B 53/04 |
| 2004/0192463 | A1 | 9/2004 | Tsurumaki et al. | |
| 2005/0009622 | A1 * | 1/2005 | Antonious | A63B 53/0466 473/345 |
| 2005/0049073 | A1 * | 3/2005 | Herber | A63B 53/0466 473/328 |
| 2022/0233921 | A1 * | 7/2022 | Mizutani | A63B 53/0462 |

* cited by examiner

Cross section E1

GOLF CLUB HEAD

CROSS REFERENCE TO RELATED APPLICATION

The present application claims priority to Japanese Patent Application No. 2021-010666 filed on Jan. 26, 2021. The entire contents of this Japanese Patent Application are hereby incorporated by reference.

BACKGROUND

Technical Field

The present disclosure relates to a golf club head.

Description of the Related Art

Rebound performance is known as one of performances required for a golf club head. A high rebound performance can increase flight distance. JP2016-47183 A discloses a head that includes a hollow protruding portion provided spaced apart from its face portion toward the back side. This protruding portion enhances rebound performance.

SUMMARY

There has been demand for a head having a higher rebound performance. The head preferably has a larger area having a high rebound performance. On the other hand, it is preferable that other performances are not sacrificed by structures for enhancing the rebound performance. A head that has a high rebound performance and is also excellent in other performances is preferable.

One of the objects of the present disclosure is to provide a golf club head having a high rebound performance.

In one aspect, the present disclosure provides a golf club head including a face portion that forms a striking face, a crown portion, a sole portion, and a hosel portion. The striking face has a face center. The sole portion includes a toe protruding portion that is a protruding portion formed on a toe side with respect to the face center and is hollow. The toe protruding portion is not present on a heel side with respect to the face center. The toe protruding portion is formed so as to be continuous with the face portion.

DESCRIPTION OF THE PREFERRED EMBODIMENTS

Hereinafter, the present disclosure will be described in detail according to the preferred embodiments with appropriate references to the accompanying drawings.

In the present disclosure, a reference state, a reference perpendicular plane, a toe-heel direction, a face-back direction, an up-down direction, a face center, a vertical cross section, a radial cross section, an evaluation cross section, and a radius of curvature are defined as follows.

Figure 12:
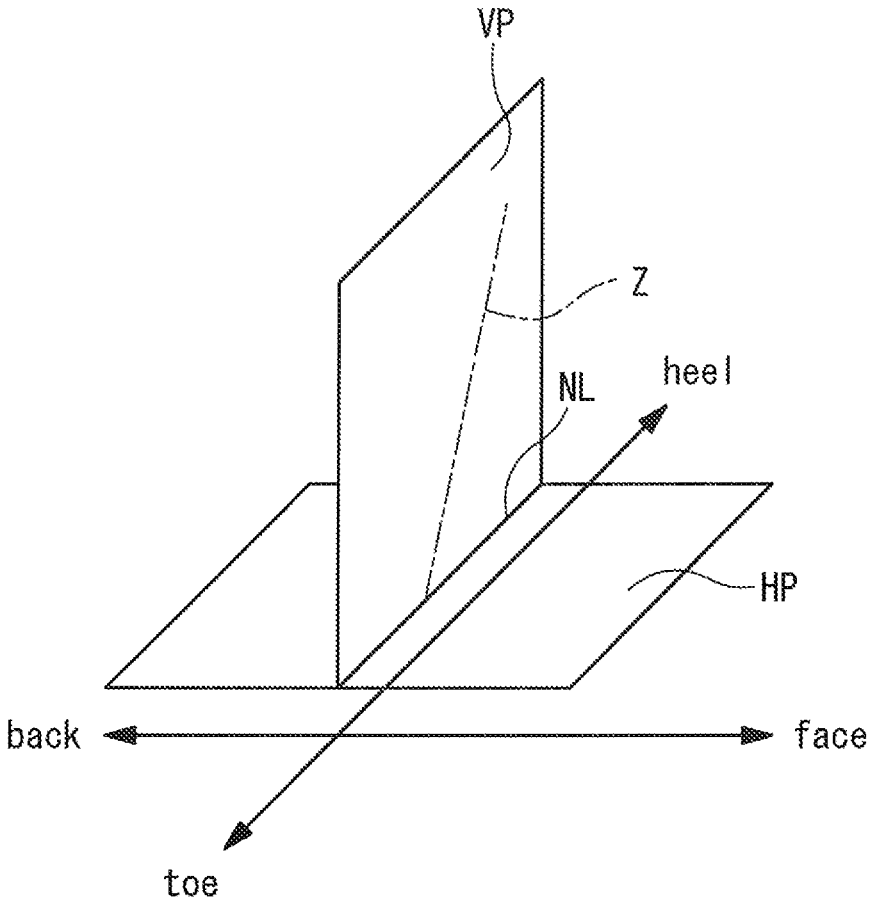
FIG. 12 is a conceptual diagram for illustrating a reference state.

The reference state is defined as a state where a head is placed at a predetermined lie angle on a ground plane HP. As shown in FIG. 12, in the reference state, a shaft axis line Z is contained in a plane VP that is perpendicular to the ground plane HP. The shaft axis line Z is the center line of a shaft. The plane VP is defined as the reference perpendicular plane. The predetermined lie angle is shown in a product catalog, for example.

In the reference state, a face angle is 0°. That is, in a planer view of the head as viewed from above, a tangent line to the head at its face center on a striking face is set to be parallel to the toe-heel direction. The definitions of the face center and the toe-heel direction are as explained below.

In the present disclosure, the toe-heel direction is the direction of an intersection line NL between the reference perpendicular plane VP and the ground plane HP (see FIG. 12). A toe side in the toe-heel direction is also simply referred to as "toe side". A heel side in the toe-heel direction is also simply referred to as "heel side".

In the present disclosure, the face-back direction is a direction that is perpendicular to the toe-heel direction and is parallel to the ground plane HP. A face side in the face-back direction is also simply referred to as "face side". A back side in the face-back direction is also simply referred to as "back side".

In the present disclosure, the up-down direction is a direction that is perpendicular to the toe-heel direction and is perpendicular to the face-back direction. In other words, the up-down direction in the present disclosure is a direction perpendicular to the ground plane HP.

In the present disclosure, the face center is determined in the following manner. First, a point Pr is selected roughly at the center of a striking face in the up-down direction and the toe-heel direction. Next, a plane that passes through the point Pr, extends in the direction of a line normal to the striking face at the point Pr, and is parallel to the toe-heel direction is determined. An intersection line between this plane and the striking face is drawn, and a midpoint Px of this intersection line is determined. Next, a plane that passes through the midpoint Px, extends in the direction of a line normal to the striking face at the midpoint Px, and is parallel to the up-down direction is determined. An intersection line between this plane and the striking face is drawn, and a midpoint Py of this intersection line is determined. Next, a plane that passes through the midpoint Py, extends in the direction of a line normal to the striking face at the midpoint Py, and is parallel to the toe-heel direction is determined. An intersection line between this plane and the striking face is drawn, and a midpoint Px of this intersection line is newly determined. Next, a plane that passes through this newly-determined midpoint Px, extends in the direction of a line normal to the striking face at this midpoint Px, and is parallel to the up-down direction is determined. An intersection line between this plane and the striking face is drawn, and a midpoint Py of this intersection line is newly determined. By repeating the above-described steps, points Px and Py are sequentially determined. In the course of repeating these steps, when the distance between a newly-determined midpoint Py and a midpoint Py determined in the immediately preceding step first becomes less than or equal to 0.5 mm, the newly-determined midpoint Py (the midpoint Py determined last) is defined as the face center.

In the present disclosure, the vertical cross section is defined as each of cross sections taken along respective planes perpendicular to the toe-heel direction. A contour line shown in the vertical cross section is also referred to as a vertical cross-sectional contour line.

Figure 2A:
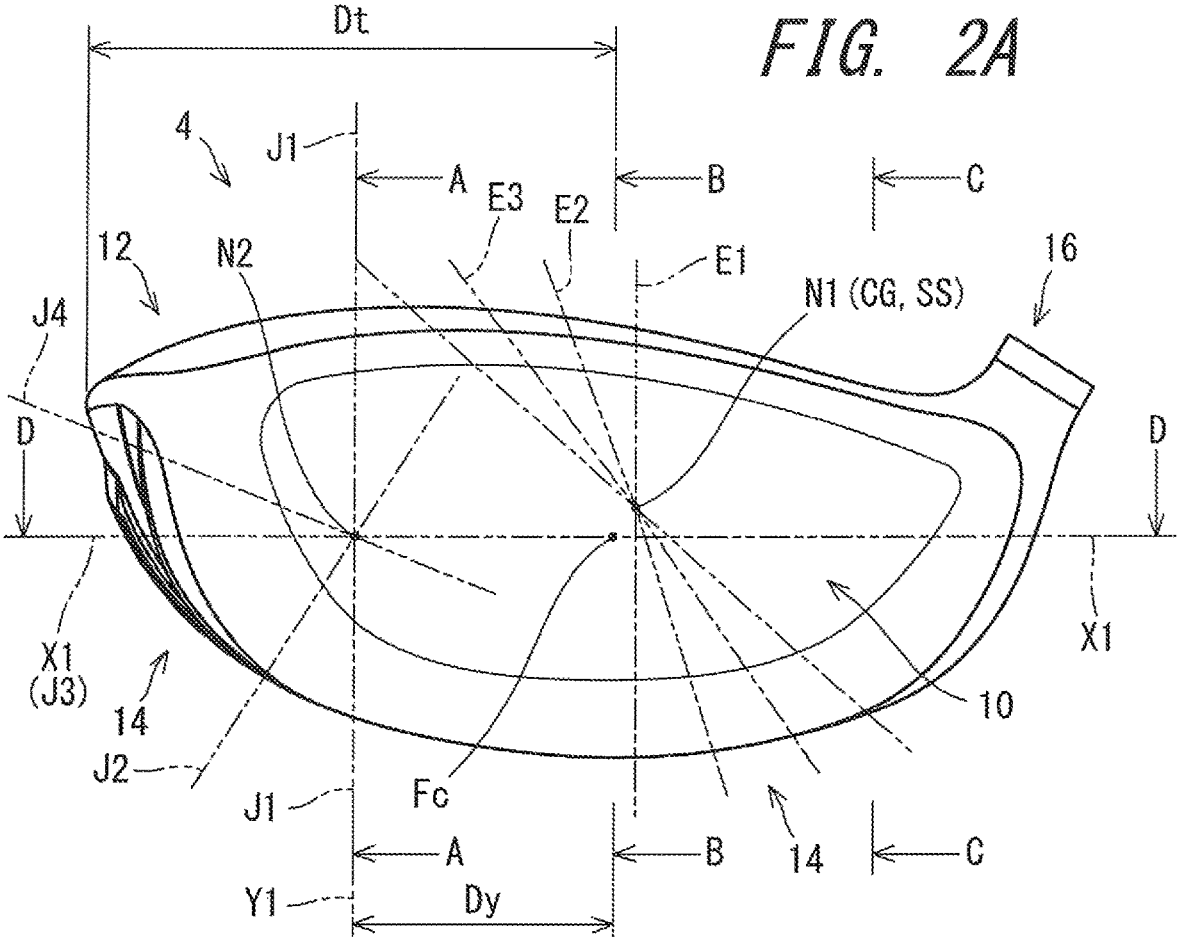
FIG. 2A is a front view of a head of the first embodiment as viewed from a face side.

In the present disclosure, a radial cross section is defined. With reference to FIG. 2A, a horizontal plane X1 that passes through the face center Fc and a vertical plane Y1 that is located on the toe side with respect to the face center Fc are set. The horizontal plane X1 is a plane parallel to the ground plane HP. The vertical plane Y1 is a plane perpendicular to the ground plane HP and parallel to the face-back direction. A double-pointed arrow Dy in FIG. 2A shows a distance in the toe-heel direction between the vertical plane Y1 and the face center Fc. A double-pointed arrow Dt in FIG. 2A shows a distance in the toe-heel direction between a toe-most point of the head 4 and the face center Fc. The distance Dy is 50% of the distance Dt. An intersection line N2 between the horizontal plane X1 and the vertical plane Y1 is determined. The radial cross section is defined as each of cross sections that includes the intersection line N2, for example, cross sections J1, J2, J3 and J4 shown in FIG. 2A. The radial cross sections are set for evaluating a toe protruding portion that extends from a toe-lower portion to a toe-upper portion of the head. A contour line shown in the radial cross section is also referred to as a radial cross-sectional contour line.

The toe protruding portion of the present disclosure is evaluated based on the vertical cross sections and the radial cross sections. The vertical cross sections are used in the evaluation of the toe protruding portion on the heel side with respect to the vertical plane Y1. The radial cross sections are used in the evaluation of the toe protruding portion on the toe side with respect to the vertical plane Y1. The vertical cross sections and the radial cross sections are used for the evaluation of the toe protruding portion. Each of the vertical cross sections and the radial cross sections is also referred to as an evaluation cross section. A contour line shown in the evaluation cross section is also referred to as an evaluation cross-sectional contour line. Hereinafter, the evaluation cross-sectional contour line is also simply referred to as "cross-sectional contour line". Since there are countless number of evaluation cross sections, there are also countless number of cross-sectional contour lines. Unless a specific cross-sectional contour line is selected, descriptions using a cross-sectional contour line can hold true in all cross-sectional contour lines.

A radius of curvature of a curved surface is measured using the cross-sectional contour line. The radius of curvature is determined at each point located on the cross-sectional contour line. The radius of curvature is determined by specifying three points on the cross-sectional contour line: a point to be measured (hereinafter referred to as measurement point), a point located 0.5 mm apart from the measurement point toward one side, and a point located 0.5 mm apart from the measurement point toward the other side. A radius of a circle that passes through these three points is defined as the radius of curvature at the measurement point. "0.5 mm" for these points is a route length measured along the cross-sectional contour line. This "0.5 mm" is a sufficiently small distance for evaluating the radius of curvature at a measurement point. In addition, by setting two points located 0.5 mm apart from the measurement point, the radius of curvature at each point on a free-form curve can be determined without the need to solve the differential equation of a cross-sectional contour line.

Figure 1:
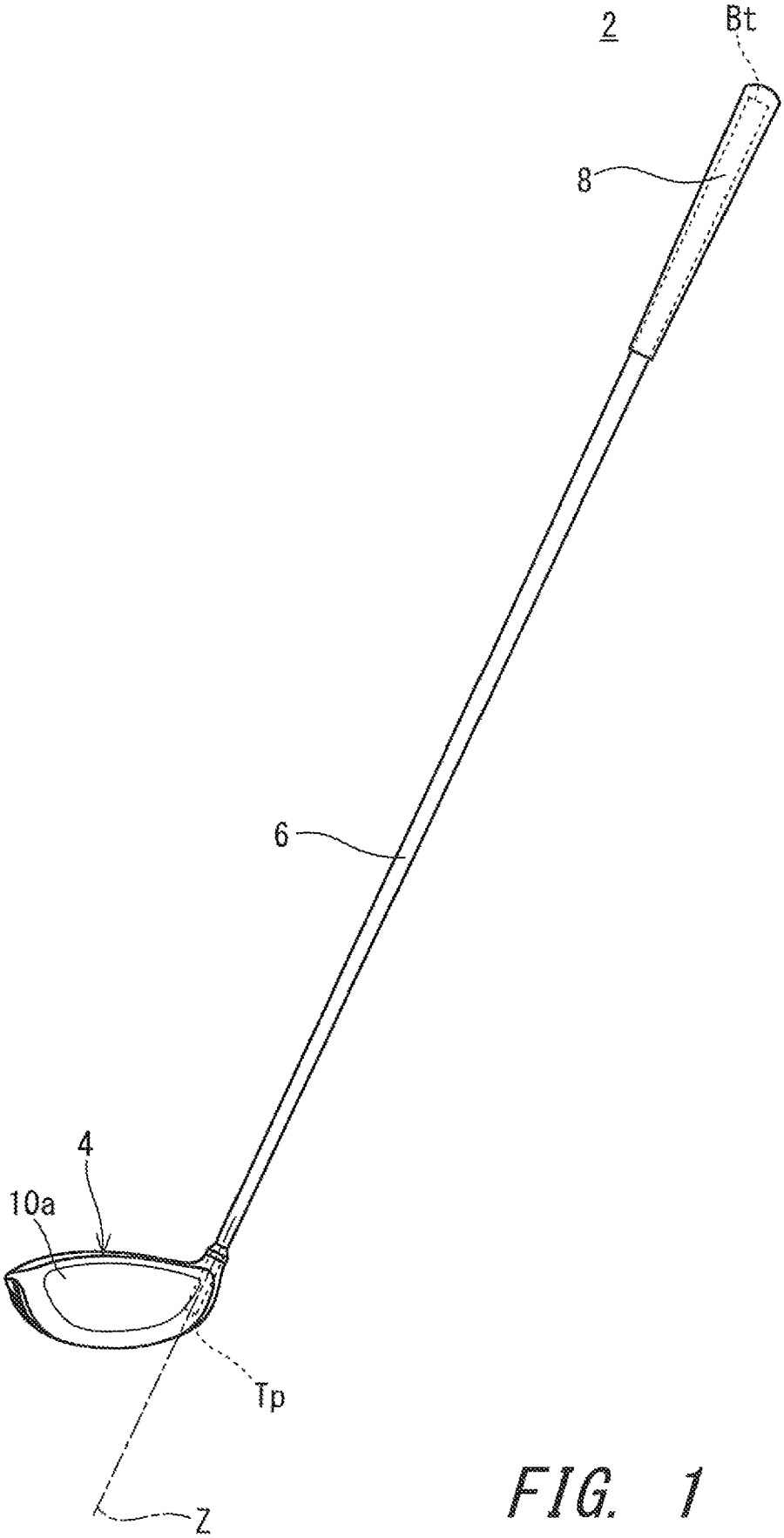
FIG. 1 shows a golf club according to a first embodiment.
Figure 2B:
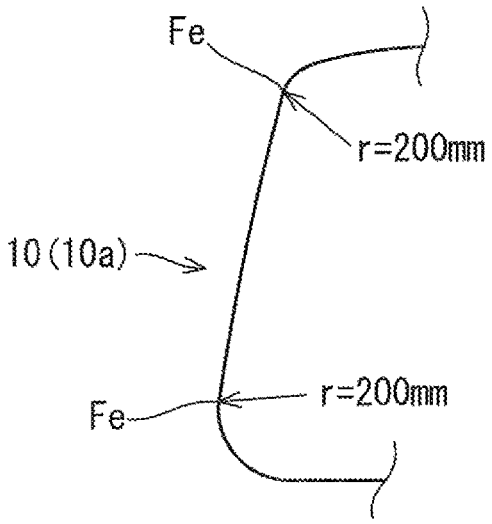
FIG. 2B shows a cross section taken along line E1 in FIG. 2A, FIG. 2B showing only a cross-sectional contour line of the outer surface of the head.
Figure 3:
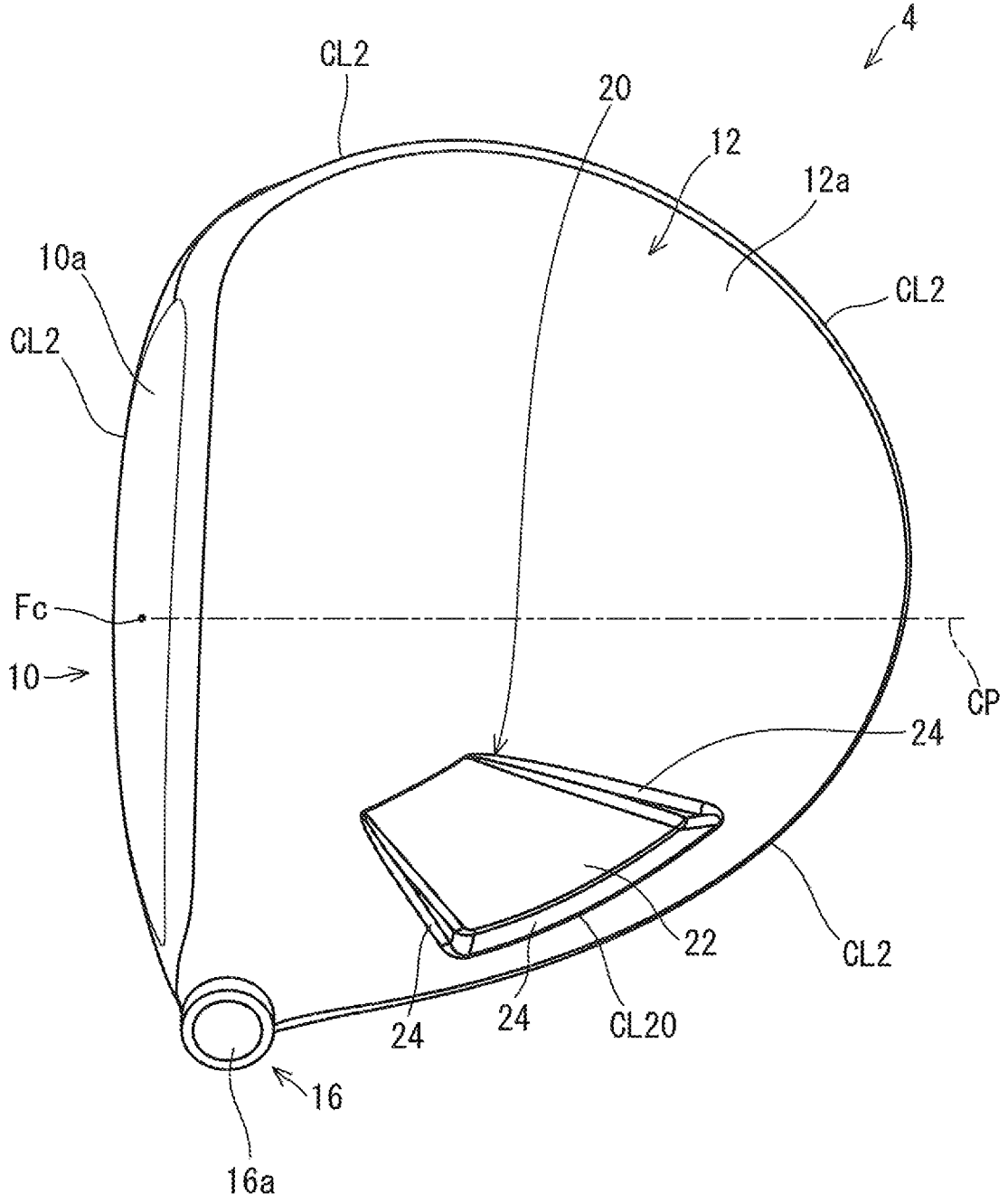
FIG. 3 is a plan view of the head of the first embodiment as viewed from a crown side.
Figure 4:
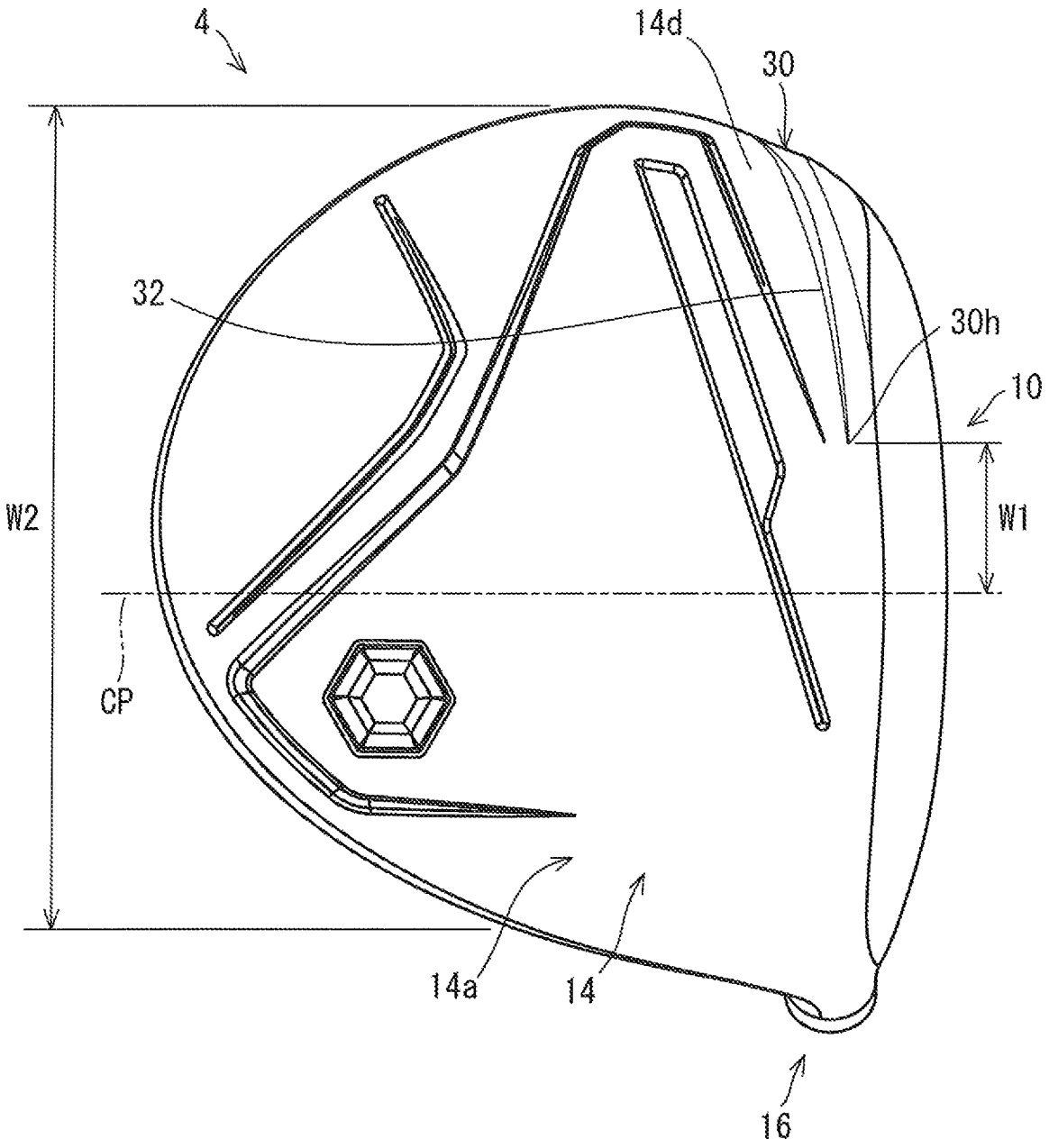
FIG. 4 is a bottom view of the head of the first embodiment as viewed from a sole side.
Figure 5:
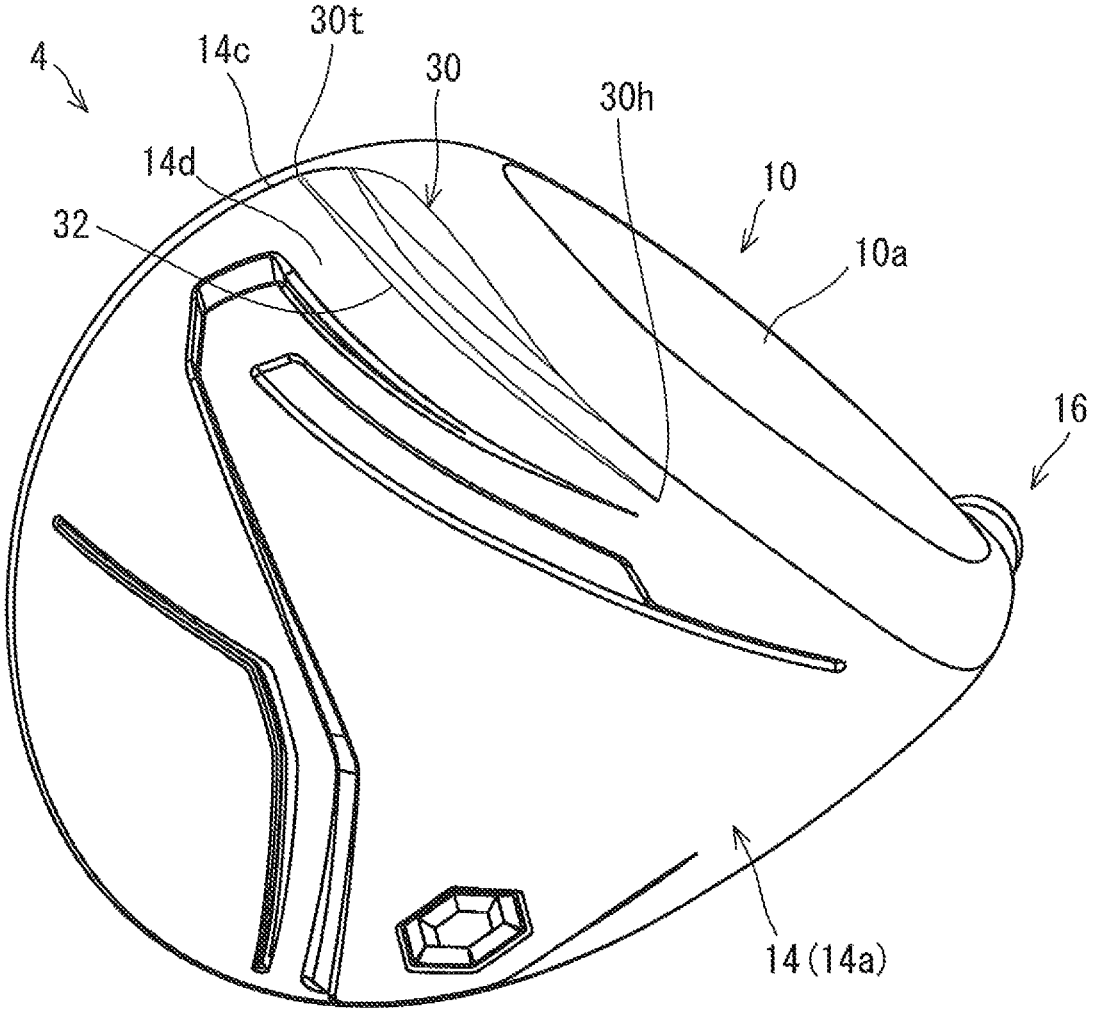
FIG. 5 is a perspective view of the head of the first embodiment as viewed from the sole side.
Figure 6A:
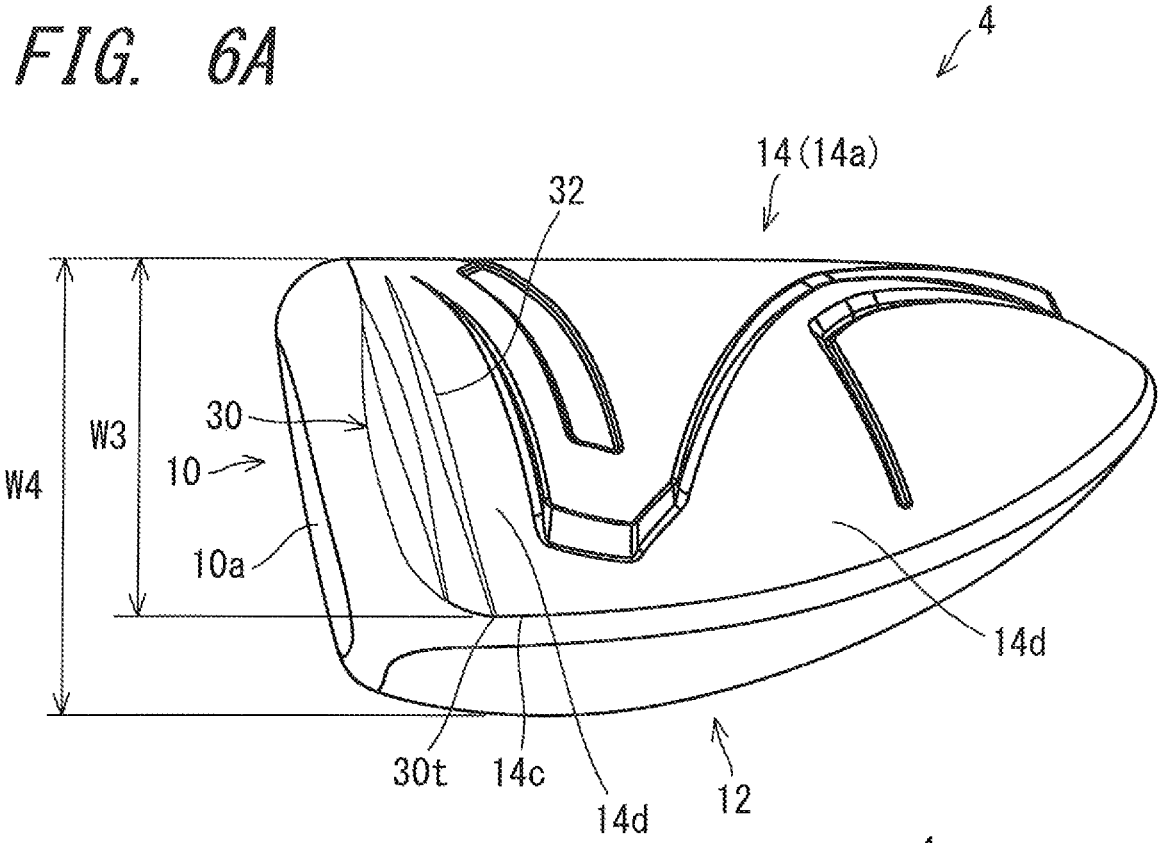
FIG. 6A is a side view of the head of the first embodiment as viewed from a toe side.
Figure 6B:
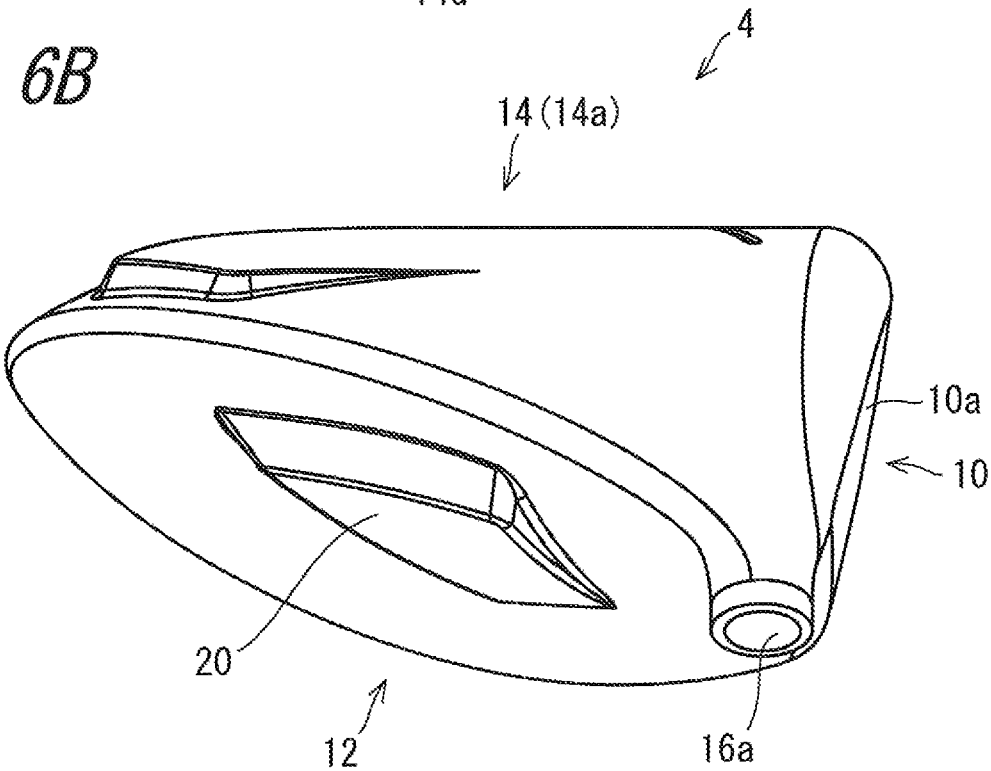
FIG. 6B is a side view of the head as viewed from a heel side.

FIG. 1 is an overall view of a golf club 2 that includes a head 4 according to an embodiment of the present disclosure. FIG. 2A is a front view of the head 4, and FIG. 2B is a cross-sectional view taken along line E1 in FIG. 2A. FIG. 3 is a plan view of the head 4 as viewed from a crown side. FIG. 4 is a bottom view of the head 4 as viewed from a sole side. FIG. 5 is a perspective view of the head 4 as viewed from the sole side. FIG. 6A is a side view of the head 4 as viewed from the toe side, and FIG. 6B is a side view of the head 4 as viewed from the heel side. In FIG. 6A and FIG. 6B, the sole portion is positioned on the upper side.

As shown in FIG. 1, the golf club 2 includes the golf club head 4, a shaft 6, and a grip 8. The shaft 6 has a tip end Tp and a butt end Bt. The head 4 is attached to a tip end portion of the shaft 6. The grip 8 is attached to a butt end portion of the shaft 6.

The golf club 2 is a driver (No. 1 wood). Typically, the club as a driver has a length of greater than or equal to 43 inches and less than or equal to 48 inches. Preferably, the golf club 2 is a wood-type golf club or a hybrid-type golf club.

The shaft 6 is in a tubular form. The shaft 6 is hollow. The material of the shaft 6 is a carbon fiber reinforced resin. From the viewpoint of reducing the weight, a carbon fiber reinforced resin is preferable as the material for the shaft 6. The shaft 6 is a so-called carbon shaft. Preferably, the shaft 6 is formed with a cured prepreg sheet. In the prepreg sheet, fibers are substantially oriented in one direction. Such a prepreg in which fibers are substantially oriented in one direction is also referred to as UD prepreg. "UD" is an abbreviation of "unidirectional". A prepreg other than the UD prepreg may be used. For example, fibers contained in the prepreg sheet may be woven. The shaft 6 may include a metal wire. The material of the shaft 6 is not limited, and may be a metal, for example.

The grip 8 is a part that a golfer grips during a swing. Examples of the material of the grip 8 include rubber compositions and resin compositions. The rubber composition for the grip 8 may contain air bubbles.

The head 4 is hollow. In the present embodiment, the head 4 is a wood type head. The head 4 may be a hybrid type head. The head 4 may be an iron type head. The head 4 may be a putter type head. The head 4 is preferably a wood type head or a hybrid type head, and more preferably a wood type head. Examples of a preferable material for the head 4 include metals and fiber reinforced plastics. Examples of the metals include titanium alloys, pure titanium, stainless steel, maraging steel, and soft iron. Examples of the fiber reinforced plastics include carbon fiber reinforced plastics. The head 4 may be a composite head including a portion made of a metal and a portion made of a fiber reinforced plastic.

As shown in FIG. 2A to FIG. 6B, the head 4 includes a face portion 10, a crown portion 12, a sole portion 14, and a hosel portion 16. The face portion 10 includes a striking face 10*a*. The striking face 10*a* is the outer surface of the face portion 10. The striking face 10*a* is also simply referred to as a face. The striking face 10*a* has a face center Fc as defined above. The hosel portion 16 has a shaft hole 16*a*. As shown in FIG. 3, the head 4 has an outer contour line CL2 in the planer view.

An outer edge of the striking face 10*a* can be defined as follows. As shown in FIG. 2A and FIG. 2B, there are cross sections each of which includes a straight line N1 that connects a center of gravity CG of the head 4 and a sweet spot SS, for example, cross sections E1, E2, and E3 in FIG. 2A. In each of the cross sections, such as the cross section E1, when a radius of curvature r of the cross-sectional contour line of the outer surface of the head is sequentially observed from the sweet spot SS toward the outside of the striking face 10*a*, a point at which the radius of curvature r becomes 200 mm for the first time is defined as a position Fe. This position Fe is defined as the outer edge of the striking face 10*a*. Note that the sweet spot SS is a foot of a perpendicular drawn from the center of gravity CG of the head 4 to the striking face 10*a*.

The crown portion 12 includes a crown protruding portion 20 on a crown outer surface 12*a*. The crown protruding portion 20 is hollow. That is, the crown protruding portion 20 forms a projection on the crown outer surface 12*a* and forms a recess on a crown inner surface. The crown protruding portion 20 includes a contour line CL20, an upper surface 22, and a sidewall surface 24. In the plan view of the head 4 (FIG. 3), the crown protruding portion 20 has a substantially quadrilateral shape (substantially trapezoidal shape). The crown protruding portion 20 is provided on the heel side with respect to the face center Fc.

Figure 7A:
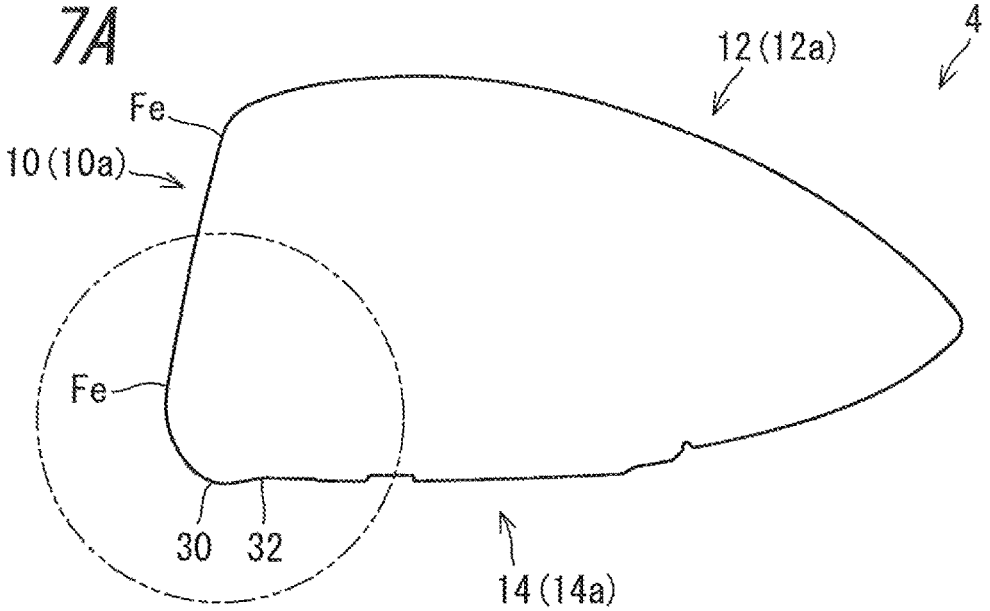
FIG. 7A is a cross-sectional view taken along line A-A in FIG. 2A, FIG. 7B a cross-sectional view taken along line B-B in FIG. 2A, and FIG. 7C a cross-sectional view taken along line C-C in FIG. 2A, each of these cross-sectional views showing only a cross-sectional contour line of the outer surface of the head.
Figure 7B:
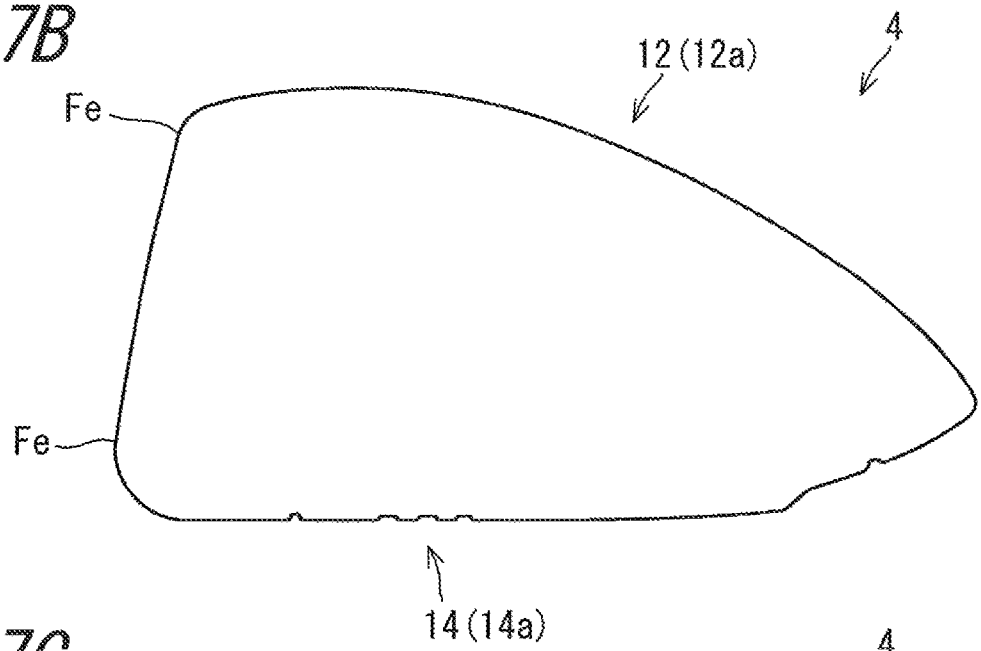
Figure 7C:
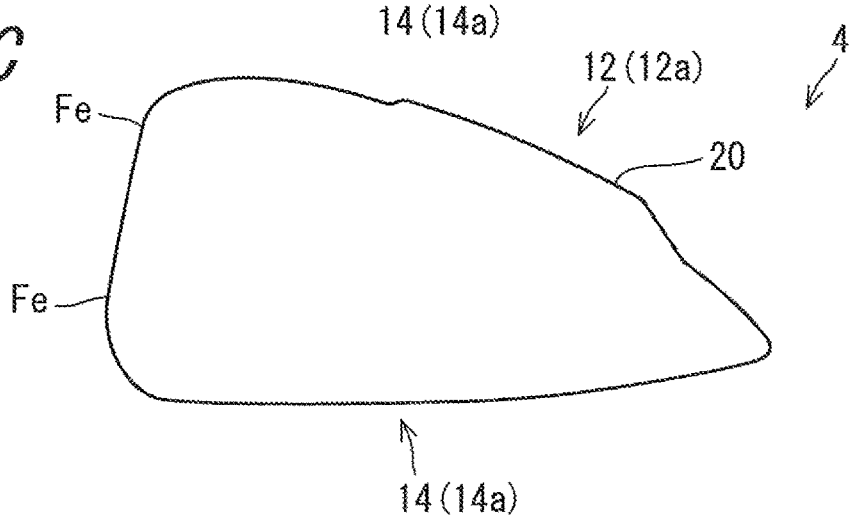
Figure 8:
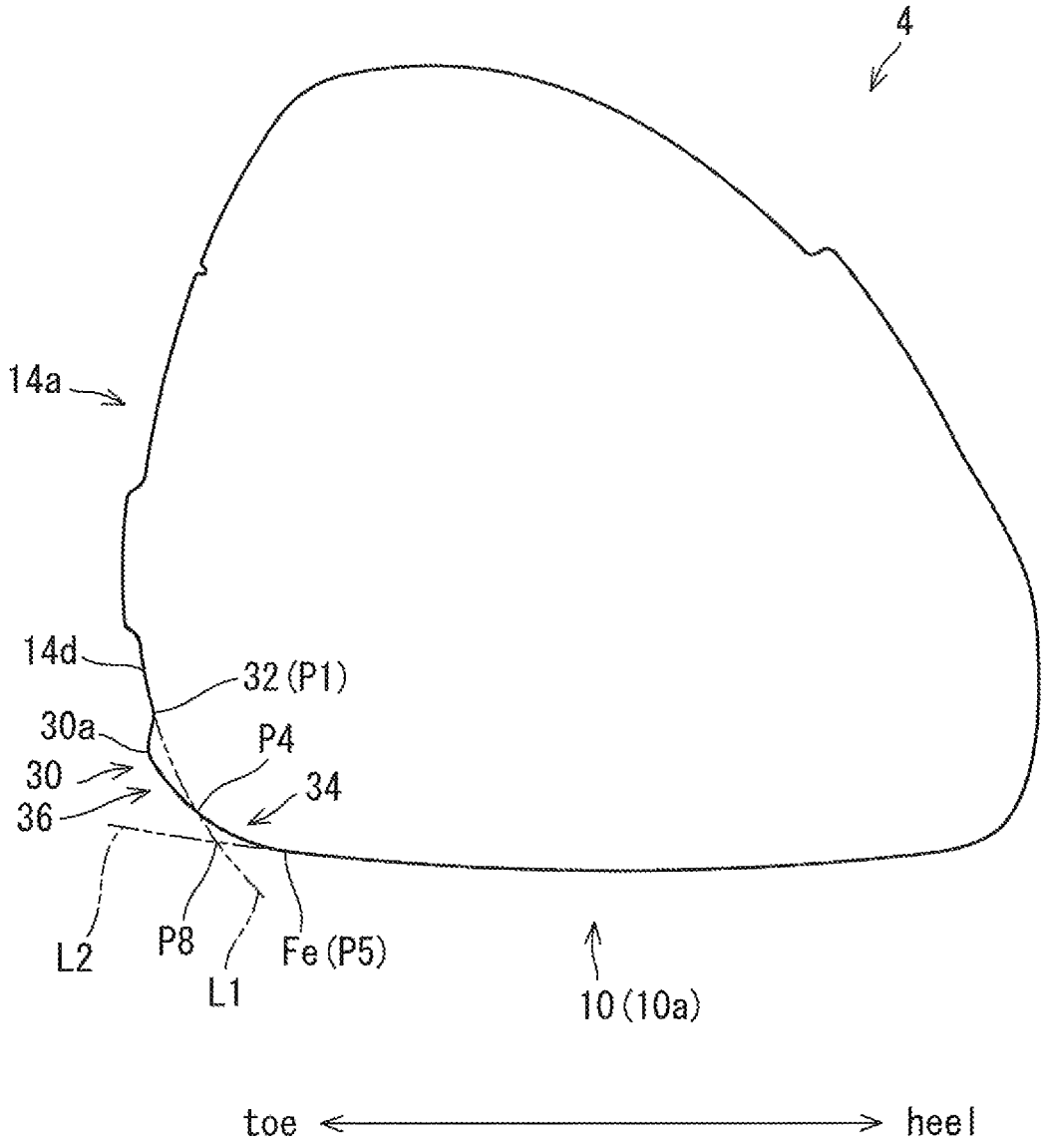
FIG. 8 is a cross-sectional view taken along line D-D in FIG. 2A, the cross-sectional view showing only a cross-sectional contour line of the outer surface of the head.

FIG. 7A is a cross-sectional view taken along line A-A in FIG. 2A. The position of line A-A coincides with the vertical plane Y1. FIG. 7A is the cross-sectional view of the radial cross section (evaluation cross section) J1 (see FIG. 2A). FIG. 7B is a cross-sectional view taken along line B-B in FIG. 2A. FIG. 7C is a cross-sectional view taken along line C-C in FIG. 2A. Each of FIG. 7A, FIG. 7B and FIG. 7C shows only the cross-sectional contour line of the outer surface of the head. FIG. 8 is a cross-sectional view taken along line D-D in FIG. 2A. The position of line D-D coincides with the position of the face center Fc. The position of line D-D coincides with the horizontal plane X1. FIG. 8 is the cross-sectional view of the radial cross section (evaluation cross section) J3 (see FIG. 2A).

The head 4 includes a toe protruding portion 30. The toe protruding portion 30 is provided on the sole portion 14. The toe protruding portion 30 is hollow. The toe protruding portion 30 protrudes toward the outside of the head 4. The toe protruding portion 30 forms a projection on a sole outer surface 14*a*. The toe protruding portion 30 forms a recess on a sole inner surface.

In the head 4, the sole portion 14 includes the entirety of the toe protruding portion 30. The head 4 does not have a side portion (skirt portion). As shown in FIG. 2A and FIG. 8, the sole portion 14 extends to an outer peripheral edge of the crown portion 12. On the toe side of the head 4, the toe protruding portion 30 extends to a position close to the crown portion 12. As is clear from the fact that the toe protruding portion 30 is shown in FIG. 8, the toe protruding portion 30 extends to reach a position located on the upper side with respect to the face center Fc. The toe protruding portion 30 does not reach the outer contour line CL2 in the plan view of the head 4 (see FIG. 3). The toe protruding portion 30 does not influence the outer contour line CL2.

Note that the sole portion 14 may have only a part of the toe protruding portion 30. The head 4 may include a side portion (skirt portion). When the head 4 includes a side portion (skirt portion), the toe protruding portion 30 may be provided from the sole portion 14 to the side portion (skirt portion).

The toe protruding portion 30 is provided on the toe side with respect to the face center Fc. The entirety of the toe protruding portion 30 is located on the toe side with respect to the face center Fc. The toe protruding portion 30 is not present on the heel side with respect to the face center Fc. As shown in FIG. 7B, the toe protruding portion 30 is not present in the vertical cross section that passes through the face center Fc. As shown in FIG. 7C, the toe protruding portion 30 is not present in any vertical cross sections taken at positions on the heel side with respect to the face center Fc.

The sole outer surface 14*a* which is the outer surface of the sole portion 14 includes a sole base surface 14*d*. The sole base surface 14*d* is a curved surface and/or a flat surface that is/are (smoothly) continuous with no step. The sole base surface 14*d* is adjacent to the toe protruding portion 30. The sole base surface 14*d* extends from a back side position of the toe protruding portion 30 toward the toe and upper side, and reaches an outer edge 14*c* of the sole outer surface 14*a* (see FIG. 5).

The sole base surface 14*d* has a boundary line 32 that defines the boundary between the sole base surface 14*d* and the toe protruding portion 30. The boundary line 32 is a back-side starting line of the toe protruding portion 30. The toe protruding portion 30 smoothly and continuously extends from the boundary line 32 that is the starting line to the outer edge Fe of the striking face 10*a*. The toe protruding portion 30 is smoothly connected to the striking face 10*a* at the outer edge Fe. It should be noted that, for example, if the second order derivative of a function of a cross-sectional contour line is continuous, the curved surface can be considered as smoothly continuous.

Figure 9:
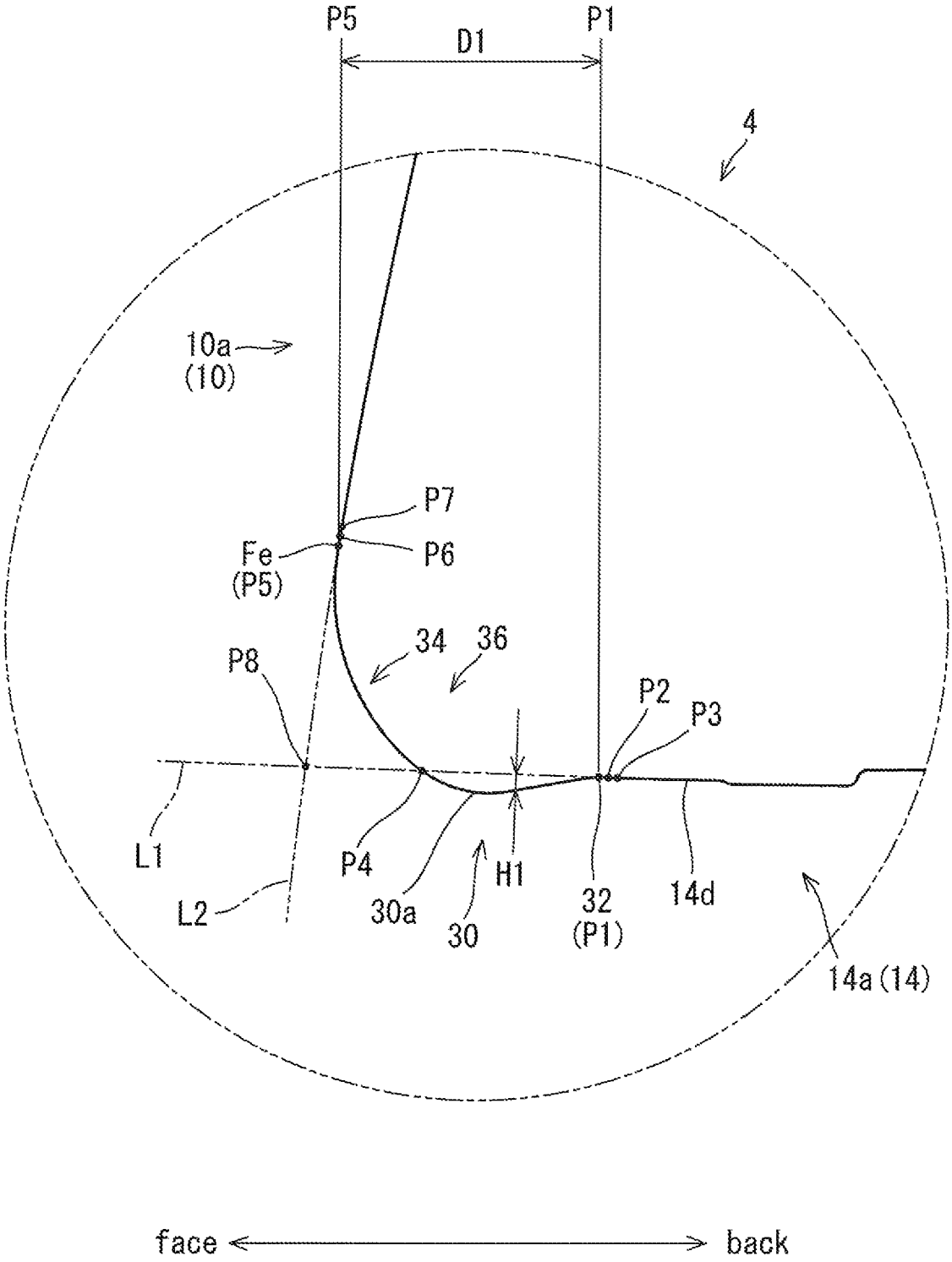
FIG. 9 is an enlarged view of a portion surrounded by a circle indicated with a two-dot chain line in FIG. 7A.

FIG. 9 is an enlarged view of a portion surrounded by a circle indicated with a two-dot chain line in FIG. 7A. When the boundary line 32 is not clearly seen from the appearance of the head 4, the boundary line 32 may be determined based on the cross-sectional contour line. As shown in FIG. 8 and FIG. 9, the sole base surface 14*d* is a straight line or a curved line in the cross-sectional contour line. When the cross-sectional contour line of the sole base surface 14*d* is a curved line, the radius of curvature of the curved line can be set to greater than or equal to 20 mm, further greater than or equal to 40 mm, and still further greater than or equal to 60 mm. When the cross-sectional contour line of the sole base surface 14*d* is a curved line, the radius of curvature of the curved line is larger than the radius of curvature of the cross-sectional contour line of the toe protruding portion 30. In the cross-sectional contour line, a starting point P1 that forms the boundary line 32 can be recognized as an inflection point, a point having a small radius of curvature, or a vertex of an angle. The point having a small radius of curvature can be defined as a point having a radius of curvature of less than or equal to 5 mm. When points each having a radius of curvature of less than or equal to 5 mm are continuously present, the point having a small radius of curvature can be defined as the middle point of a region in which those points are present.

In the cross-sectional contour line, a virtually extended line L1 of the sole base surface 14*d* can be defined. As shown in FIG. 9, a point P2 located on the back side of the starting point P1 and a point P3 located on the back side of the point P2 are determined. The distance between the starting point P1 and the point P2 is 0.5 mm, and the distance between the point P2 and the point P3 is 0.5 mm. "0.5 mm" for these points is a route length measured along the cross-sectional contour line. A circle or a straight line that passes through the point P1, the point P2, and the point P3 is defined as the virtually extended line L1. In FIG. 8 and FIG. 9, the virtually extended line L1 is indicated by a two-dot chain line.

The toe protruding portion 30 protrudes further outward (toward the outside of the head 4) than the virtually extended line L1. An intersection point P4 between the cross-sectional contour line of the outer surface of the head 4 and the virtually extended line L1 is present. The intersection point P4 is located between the starting point P1 and a point P5 that forms the outer edge Fe of the striking face 10*a*. The intersection point P4 can be considered as an end point of the toe protruding portion 30. In other words, the intersection point P4 can be considered as a face-side starting point of the toe protruding portion 30. However, the toe protruding portion 30 and a transition portion 34 are connected to each other so as to form a continuous convex curved surface, and thus the face-side starting point P4 of the toe protruding portion 30 is not recognized from the appearance of the head 4.

In the cross-sectional contour line, a virtually extended line L2 of the striking face 10*a* can be defined. As shown in FIG. 9, a point P6 located on the upper side of the point P5 forming the outer edge Fe, and a point P7 located on the upper side of the point P6 are determined. The distance between the point P5 and the point P6 is 0.5 mm, and the distance between the point P6 and the point P7 is 0.5 mm. "0.5 mm" for these points is a route length measured along the cross-sectional contour line. A circle or a straight line that passes through the point P5, the point P6, and the point P7 is defined as the virtually extended line L2. When the striking face 10*a* has a roll, the points P5, P6, and P7 are not located on a single straight line, normally. In this case, a circle passing through the point P5, the point P6, and the point P7 is used as the virtually extended line L2. In FIG. 8 and FIG. 9, the virtually extended line L2 is indicated by a two-dot chain line.

In the cross-sectional contour line, the toe protruding portion 30 has an apex 30*a*. The apex 30*a* is a point farthest from the virtually extended line L1. That is, in the cross-sectional contour line, the apex 30*a* is a point at which a height H1 is at the maximum. The height H1 will be detailed later.

The virtually extended line L1 and the virtually extended line L2 intersect with each other at one point. FIG. 8 and FIG. 9 show the intersection point as a point P8. In the cross-sectional contour line of FIG. 9, the toe protruding portion 30 protrudes further downward than the intersection point P8. In the cross-sectional contour line of FIG. 8, the toe protruding portion 30 protrudes further toward the toe side than the intersection point P8. As described above, in the cross-sectional contour line, the toe protruding portion 30 protrudes further outward (toward the outside of the head 4) than the intersection point P8.

The toe protruding portion 30 is formed so as to be continuous with the face portion 10. The toe protruding portion 30 is formed on the back side of the face portion 10. The toe protruding portion 30 is provided on the immediate back side of the face portion 10 with no gap between the toe protruding portion 30 and the face portion 10. As well shown in FIG. 9, the toe protruding portion 30 is connected to the striking face 10*a* with a smooth convex curved surface. As well shown in FIG. 9, in the cross-sectional contour line, the toe protruding portion 30 is connected to the striking face 10*a* with a curved line that is convex toward the outside.

By providing the toe protruding portion 30 formed continuously with the face portion 10, a bending point of the head when the head is deformed at impact can be shifted to the apex 30*a* of the toe protruding portion 30. In conventional golf club heads, this bending point is located at a boundary (corner part) between the face portion 10 and the sole portion 14. By shifting the bending point to the apex of the toe protruding portion 30, a region to be deformed (hereinafter, also referred to as "deformation region") in the striking face 10*a* can be enlarged. In addition, the amount of deformation of the striking face 10*a* can be increased. Accordingly, the rebound performance of the head can be improved.

The center of gravity CG of the head (hereinafter also referred to as head center of gravity CG) can be shifted to a lower-side position by the presence of the toe protruding portion 30 that protrudes downward. The head center of gravity CG can be shifted to a face-side position by the presence of the toe protruding portion 30 located at a face-most position of the sole portion 14. Since the head center of gravity CG is shifted to a lower-side and face-side position, the position of the center of gravity of the head 4 is lowered, and the position of the sweet spot is also lowered.

The mass of the head is distributed to the peripheral side of the head by the toe protruding portion 30 protruding toward the outside of the head. Accordingly, the moment of inertia of the head can be increased.

By providing the toe protruding portion 30 formed continuously with the face portion 10, a convex curved surface that has a large radius of curvature and a large area is formed at the boundary between the face portion 10 and the sole portion 14. More specifically, the transition portion 34 and a convex curved surface region 36 which are detailed later are formed by the toe protruding portion 30. Normally, the convex curved surface can effectively reduce turf resistance at and/or near impact. This convex curved surface improves the sliding motion of the sole portion 14.

As shown in FIG. 4 and FIG. 5, the toe protruding portion 30 has a heel-side end 30*h*. The heel-side end 30*h* is located on the toe side with respect to the face center Fc. The entirety of the toe protruding portion 30 is formed on the toe side with respect to the face center Fc. The toe protruding portion 30 is not present on the lower side of the face center Fc. The toe protruding portion 30 is not present on the heel side with respect to the face center Fc. Any projecting portion that is continuous with the face portion 10 is not present on the lower side of the face center Fc. Any projecting portion that is continuous with the face portion 10 is not present on the heel side with respect to the face center Fc.

It is known that golfers usually address a golf ball in a state where a club is held at a flatter lie angle than the original lie angle of the club. That is, golfers usually address a golf ball in a state where an angle formed between the ground surface and the golf club shaft is smaller than the original lie angle of the club. Accordingly, only a heel-side part of the sole portion 14 is brought into contact with the ground surface at address. Since the toe protruding portion 30 is provided only on the toe side with respect to the face center Fc, the toe protruding portion 30 is not brought into contact with the ground surface at address. For this reason, the toe protruding portion 30 does not obstruct the address motion, and the posture of the head at address is stabilized.

At the position of the face center Fc, the width of the face portion 10 in the up-down direction is large, and thus the face portion 10 is easily bent. On the other hand, in a toe-side part with respect to the face center Fc, the width of the face portion 10 in the up-down direction is relatively small. By providing the toe protruding portion 30 on the toe side, the coefficient of restitution in the toe-side part of the face portion 10 can be made closer to the coefficient of restitution at the face center Fc. That is, an area having a high rebound performance (hereinafter referred to as high rebound performance area) can be enlarged toward the toe side.

Due to the presence of the hosel portion 16, the sweet spot SS is likely to be positioned on the heel side and upper side with respect to the face center Fc (see FIG. 2A). By providing the toe protruding portion 30 only on the toe-side part of the sole portion 14, the position of the sweet spot SS can be shifted to the toe side and lower side. The toe protruding portion 30 can contribute to positioning the sweet spot SS closer to the face center Fc.

A reference sign CP in FIG. 3 and FIG. 4 shows a plane that passes through the face center Fc, is perpendicular to the ground plane HP, and is parallel to the face-back direction. The toe protruding portion 30 is located on the toe side with respect to the plane CP.

A double-pointed arrow W1 in FIG. 4 shows a distance in the toe-heel direction between the heel-side end 30*h* of the toe protruding portion 30 and the face center Fc. A double-pointed arrow W2 in FIG. 4 shows a width of the head 4 in the toe-heel direction. A heel-side starting point for the measurement of the width W2 is a point having a height from the ground plane HP of 0.875 inches (22.23 mm) in the reference state. That is, in the reference state, a point that has a height from the ground plane HP of 0.875 inches and is located at a heel-most position is the heel-side starting point of the width W2.

There is no limitation on a ratio (W1/w2). From the viewpoint of stability of the posture of the head at address, the ratio (W1/w2) is preferably greater than or equal to 0.05, more preferably greater than or equal to 0.10, and still more preferably greater than or equal to 0.15. In order to enhance advantageous effects brought by the toe protruding portion 30, such as improvement in rebound performance, the toe protruding portion 30 preferably has a longer length. From this viewpoint, the ratio (W1/w2) is preferably less than or equal to 0.35, more preferably less than or equal to 0.30, and still more preferably less than or equal to 0.25.

As shown in FIG. 5 and FIG. 6, the toe protruding portion 30 has a toe-side end 30*t*. The toe-side end 30*t* is located on the upper side with respect to the face center Fc. That is, in the toe-side part of the head, the toe protruding portion 30 extends to reach a position located on the upper side with respect to the face center Fc. As shown in FIG. 3, the toe protruding portion 30 does not reach the outer contour line CL2 in the planer view (plan view in FIG. 3) of the head 4 which is in the reference state. In this planer view, the toe protruding portion 30 does not form any part of the outer contour line CL2 of the head 4. Note that this planer view is a projected figure obtained by projecting the head which is in the reference state onto a plane parallel to the ground plane HP.

When the toe protruding portion 30 forms a part of the outer contour line CL2 of the head 4 in the planer view, a recess can be formed on the outer contour line CL2 of the head. A head having such a recess may violate golf rules. The head 4 does not violate the rules.

A double-pointed arrow W3 in FIG. 6A shows a distance in the up-down direction between the ground plane HP and the toe-side end 30*t*. A double-pointed arrow W4 in FIG. 6A shows a width of the head 4 in the up-down direction. In the measurement of the width W4, the hosel portion 16 is excluded.

There is no limitation on a ratio (W3/W4). In order to enhance advantageous effects brought by the toe protruding portion 30, such as improvement in rebound performance, the toe protruding portion 30 preferably has a longer length. From this viewpoint, the ratio (W3/W4) is preferably greater than or equal to 0.60, more preferably greater than or equal to 0.65, and still more preferably greater than or equal to 0.70. When the toe protruding portion 30 is located closer to the outer contour line CL2 (see FIG. 3), a recess tends to be formed on the outer contour line CL2 of the head. From the viewpoint of the golf rules, the ratio (W3/W4) is preferably less than or equal to 0.95, more preferably less than or equal to 0.90, and still more preferably less than or equal to 0.85.

The toe protruding portion 30 and the striking face 10*a* are made continuous with each other by a curved surface that is convex toward the outside of the head 4. In the cross-sectional contour line, a region extending from the point P5 that is the face outer edge to the intersection point P4 can be the transition portion 34 that connects the toe protruding portion 30 and the striking face 10*a*. The transition portion 34 is a curved surface that is convex toward the outside of the head. The radius of curvature of the transition portion 34 influences the deformation of the striking face 10*a* at impact. By increasing the radius of curvature of the transition portion 34, a bending deformation in the transition portion 34 is suppressed, and the starting point of bending at impact can be shifted to the apex 30*a* located on further back side than the transition portion 34. As a result, the deformation region of the striking face 10*a* at impact can be enlarged, which can improve the rebound performance. From this viewpoint, the radius of curvature (a minimum value of radii of curvature at respective points on the transition portion 34) of the transition portion 34 is preferably greater than or equal to 7 mm, more preferably greater than or equal to 8 mm, and still more preferably greater than or equal to 9 mm. When the radius of curvature is excessive large, a distance between the outer edge Fe of the striking face 10*a* and the sole surface becomes excessively large, whereby the width of the striking face 10*a* in the up-down direction can become excessively small. From this viewpoint, the radius of curvature (a maximum value of the radii of curvature at respective points on the transition portion 34) of the transition portion 34 is preferably less than or equal to 25 mm, more preferably less than or equal to 23 mm, and still more preferably less than or equal to 20 mm.

The transition portion 34 and the toe protruding portion 30 form a convex curved surface that is continuous from the outer edge Fe of the striking face 10*a* to the apex 30*a* of the toe protruding portion 30. In the cross-sectional contour line, the region extending from the point P5 that is the face outer edge to the apex 30*a* of the toe protruding portion 30 is a convex curved surface region 36 that is formed by the transition portion 34 and a part of the toe protruding portion 30. The convex curved surface region 36 is a curved surface that is convex toward the outside of the head. The radius of curvature of the convex curved surface region 36 influences the deformation of the striking face 10*a* at impact. By increasing the radius of curvature of the convex curved surface region 36, a bending deformation in the convex curved surface region 36 is suppressed, and the starting point of bending at impact can be shifted to the apex 30*a* located on the further back side than the convex curved surface region 36. As a result, the deformation region of the striking face 10*a* at impact can be enlarged, which can improve the rebound performance. From this viewpoint, the radius of curvature (a minimum value of radii of curvature at respective points on the convex curved surface region 36) of the convex curved surface region 36 is preferably greater than or equal to 7 mm, more preferably greater than or equal to 8 mm, and still more preferably greater than or equal to 9 mm. When the radius of curvature is excessively large, the distance between the outer edge Fe of the striking face 10*a* and the sole surface becomes excessively large, or the height of the toe protruding portion 30 becomes excessively large. From this viewpoint, the radius of curvature (a maximum value of the radii of curvature at respective points on the convex curved surface region 36) of the convex curved surface region 36 is preferably less than or equal to 35 mm, more preferably less than or equal to 33 mm, and still more preferably less than or equal to 30 mm.

A double-pointed arrow H1 in FIG. 9 shows the height of the toe protruding portion 30. The height H1 is a height from the virtually extended line L1. The height H1 can be measured in the cross-sectional contour line. The height H1 can be the length of a perpendicular drawn to the virtually extended line L1.

From the viewpoint of enlarging the deformation region of the striking face 10*a*, the height H1 at the apex 30*a* is preferably greater than or equal to 1.5 mm, more preferably greater than or equal to 2 mm, and still more preferably greater than or equal to 2.5 mm. An excessively large height H1 increases the weight of the toe protruding portion 30, which can reduce the degree of freedom in the design of the head 4. From this viewpoint, the height H1 at the apex 30*a* is preferably less than or equal to 8 mm, more preferably less than or equal to 6 mm, and still more preferably less than or equal to 4 mm.

A double-pointed arrow D1 in FIG. 9 shows a distance between the lower edge Fe (point P5) of the striking face 10*a* and the back-side starting point P1 of the toe protruding portion 30. The distance D1 is measured in the face-back direction. From the viewpoint of enhancing the rebound performance, the toe protruding portion 30 is provided so as to be continuous with the face portion 10. From this viewpoint, at each position in the toe-heel direction, the distance D1 is preferably less than or equal to 25 mm, more preferably less than or equal to 23 mm, and still more preferably less than or equal to 20 mm. From the viewpoint of increasing the radius of curvature of the convex curved surface region 36 to enhance the rebound performance, the distance D1 is preferably greater than or equal to 8 mm, more preferably greater than or equal to 10 mm, and still more preferably greater than or equal to 12 mm.

In a cross section taken along the face-back direction, a minimum radius of curvature of the outer surface of the toe protruding portion 30 is determined. In other words, the minimum radius of curvature of the toe protruding portion 30 is determined in the cross-sectional contour line shown in FIG. 9. It is preferable that a portion having the minimum radius of curvature is located at or in the vicinity of the apex 30*a*. The route distance from the apex 30*a* to the vicinity of the apex 30*a* is preferably less than or equal to 2 mm, more preferably less than or equal to 1.5 mm, and still more preferably less than or equal to 1 mm. By positioning the portion having the minimum radius of curvature, this portion having the minimum radius of curvature can be the bending point at impact, and thus the deformation region of the face portion 10 can be enlarged.

From the viewpoint of bendability, the minimum radius of curvature of the outer surface of the toe protruding portion 30 is preferably less than or equal to 12 mm, more preferably less than or equal to 10 mm, still more preferably less than or equal to 8 mm, and yet still more preferably less than or equal to 6 mm. Considering easiness of surface polishing process and forming process in manufacturing the head, the minimum radius of curvature is preferably greater than or equal to 0.5 mm, more preferably greater than or equal to 0.8 mm, and still more preferably greater than or equal to 1 mm.

Figure 10:
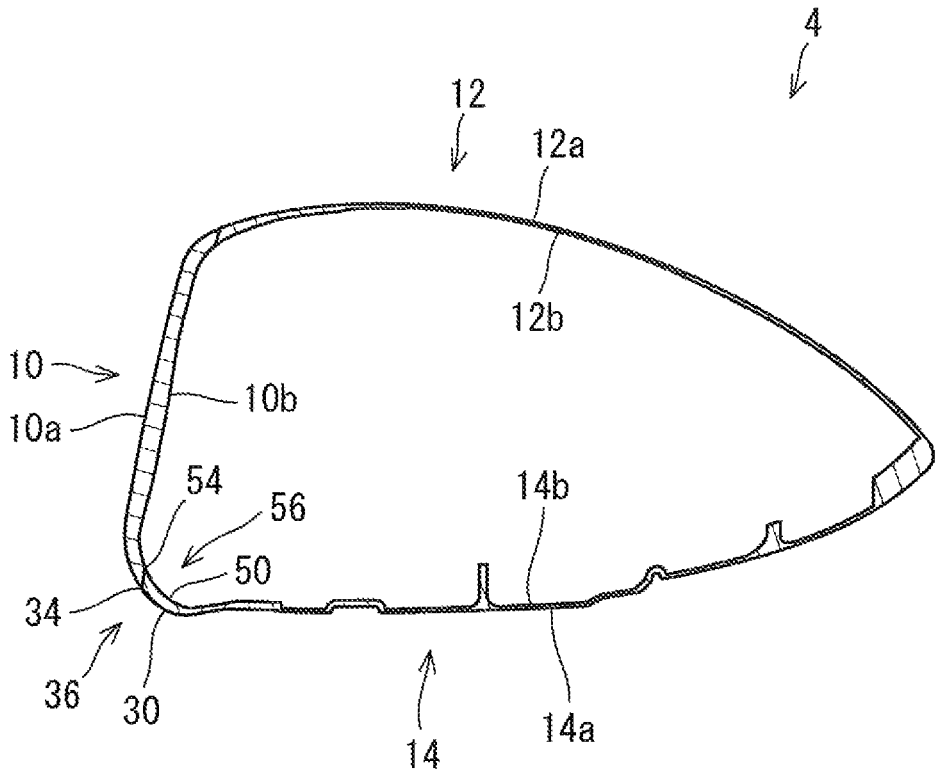
FIG. 10 is a cross-sectional view taken along line A-A in FIG. 2A, this cross-sectional view including the cross section (wall thickness) of the head.

FIG. 10 is a cross-sectional view taken along line A-A in FIG. 2A. This cross-sectional view is a normal cross-sectional view showing the wall thickness of the head 4. As shown in FIG. 10, the face portion 10 includes a face outer surface 10*a* and a face inner surface 10*b*. The face outer surface 10*a* is the striking face. The face inner surface 10*b* faces an internal space (hollow portion) of the head 4. The crown portion 12 includes the crown outer surface 12*a* and a crown inner surface 12*b*. The crown inner surface 12*b* faces the internal space (hollow portion) of the head 4. The sole portion 14 includes the sole outer surface 14*a* and a sole inner surface 14*b*. The sole inner surface 14*b* faces the internal space (hollow portion) of the head 4.

As described above, the toe protruding portion 30 is hollow. The toe protruding portion 30 forms a projection on the sole outer surface 14*a* and forms a recess on the sole inner surface 14*b*. The recess on the sole inner surface 14*b* can be also described as a recess on the head inner surface and a projection that protrudes toward the outside of the head.

An inner surface 50 of the toe protruding portion 30 and the face inner surface 10*b* are made continuous with each other by a concave curved surface. The concave curved surface is an inner surface transition portion 54. The inner surface transition portion 54 is an inner surface of the transition portion 34. For the same reason as discussed above for the transition portion 34, the radius of curvature of the inner surface transition portion 54 is preferably greater than or equal to 7 mm, more preferably greater than or equal to 8 mm, and still more preferably greater than or equal to 9 mm. For the same reason as discussed above for the transition portion 34, the radius of curvature of the inner surface transition portion 54 is preferably less than or equal to 25 mm, more preferably less than or equal to 23 mm, and still more preferably less than or equal to 20 mm.

The inner surface of the convex curved surface region 36 is a concave curved surface region 56. The inner surface transition portion 54 and the inner surface 50 form a continuous concave curved surface. For the same reason as discussed above for the convex curved surface region 36, the radius of curvature of the concave curved surface region 56 is preferably greater than or equal to 7 mm, more preferably greater than or equal to 8 mm, and still more preferably greater than or equal to 9 mm. For the same reason as discussed above for the convex curved surface region 36, the radius of curvature of the concave curved surface region 56 is preferably less than or equal to 35 mm, more preferably less than or equal to 33 mm, and still more preferably less than or equal to 30 mm.

Note that correspondence between the outer surface and the inner surface of the head is determined based on a line normal to the outer surface. Accordingly, for example, the inner surface transition portion 54 is formed by a set of intersection points between the inner surface of the head and lines normal to the transition portion 34 at respective points on the transition portion 34.

From the viewpoint of shifting the starting point of bending at impact toward the back side, the wall thickness of the convex curved surface region 36 is preferably greater than or equal to 0.6 mm, more preferably greater than or equal to 0.65 mm, and still more preferably greater than or equal to 0.7 mm. From the viewpoint of bendability at and in the vicinity of the apex 30*a* of the toe protruding portion 30, in each evaluation cross section, the wall thickness of the convex curved surface region 36 is preferably greater than or equal to the minimum wall thickness of the toe protruding portion 30 at or in the vicinity of the apex 30*a*. From the viewpoint of shifting the starting point of bending at impact toward the back side, the minimum wall thickness of the convex curved surface region 36 is preferably equal to the minimum wall thickness of the toe protruding portion 30 at and in the vicinity of the apex 30*a*. From the viewpoint of shifting the starting point of bending at impact toward the back side, it is preferable that the wall thickness of the convex curved surface region 36 decreases continuously or stepwise toward the apex 30*a*. From the viewpoint of bendability at and in the vicinity of the apex 30*a*, the minimum wall thickness of the toe protruding portion 30 at and in the vicinity of the apex 30*a* is preferably less than or equal to 2.0 mm, more preferably less than or equal to 1.8 mm, and still more preferably less than or equal to 1.6 mm. From the viewpoint of strength, the minimum wall thickness of the toe protruding portion 30 at and in the vicinity of the apex 30*a* is preferably greater than or equal to 0.6 mm, more preferably greater than or equal to 0.65 mm, and still more preferably greater than or equal to 0.7 mm. These wall thicknesses are measured along respective lines normal to the outer surface of the head. The vicinity of the apex 30*a* can mean a region that extends from the apex 30*a* to a position having a distance from the apex 30*a* of less than or equal to 2 mm. This distance (2 mm) is a route length measured along the cross-sectional contour line of the outer surface of the toe protruding portion 30.

Figure 11A:
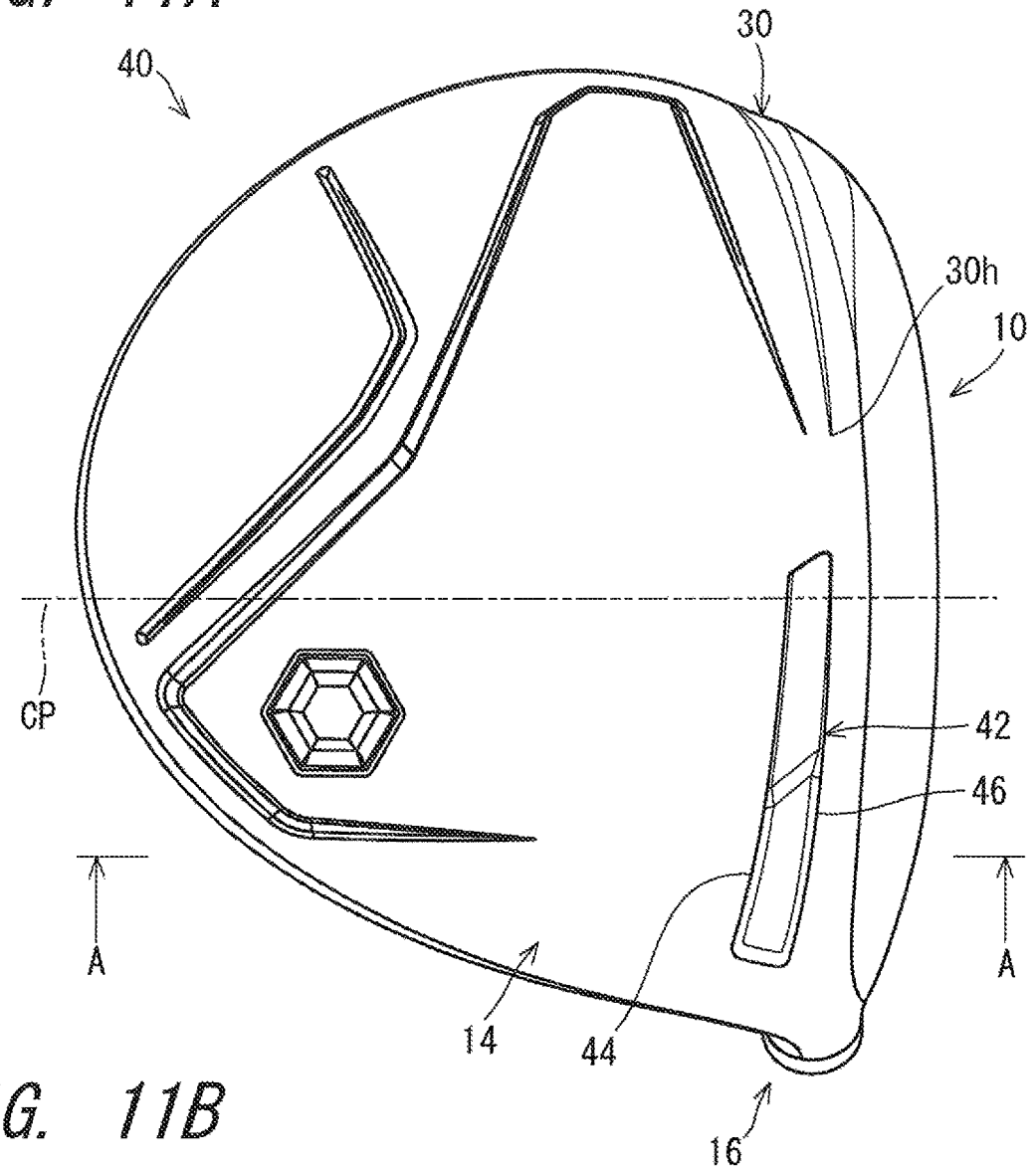
FIG. 11A is a bottom view of a head according to a second embodiment as viewed from a sole side.
Figure 11B:
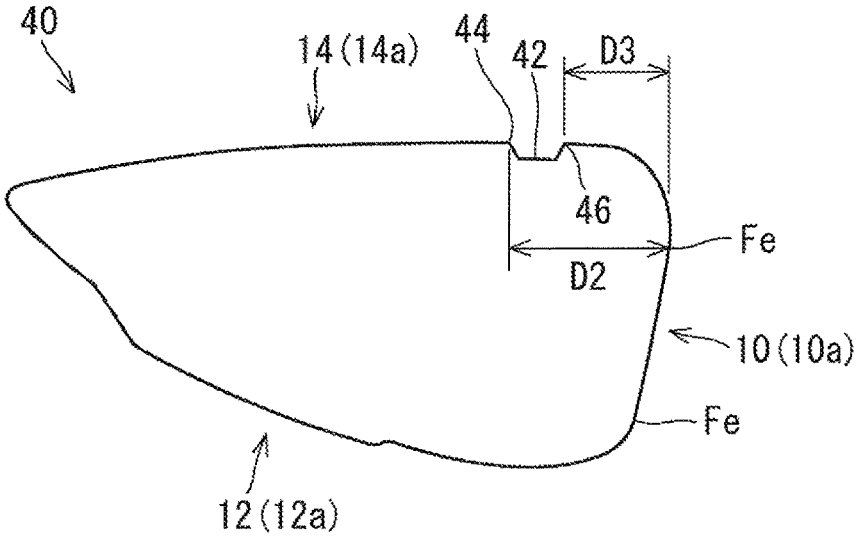
FIG. 11B is a cross-sectional view taken along line A-A in FIG. 11A, FIG. 11B showing only a cross-sectional contour line of the outer surface of the head.

FIG. 11A is a bottom view of a head 40 according to a second embodiment as viewed from the sole side. FIG. 11B is a cross-sectional view taken along line A-A in FIG. 11A. In FIG. 11B, only the cross-sectional contour line of the head outer surface is shown.

The head 40 includes a face portion 10, a crown portion 12, a sole portion 14, and a hosel portion 16. The face portion 10 includes a striking face 10*a*. The striking face 10*a* is the outer surface of the face portion 10. The striking face 10*a* has a face center Fc (not shown) as defined above. The crown portion 12 forms a crown outer surface 12*a*. The sole portion 14 forms a sole outer surface 14*a*. The sole portion 14 includes a toe protruding portion 30. A reference sign CP shows a plane that passes through the face center Fc, is perpendicular to the ground plane HP, and is parallel to the face-back direction. The toe protruding portion 30 is located on the toe side with respect to the plane CP.

The sole portion 14 includes a heel groove 42. The difference between the head 40 of the second embodiment and the head 4 of the first embodiment is only the presence or absence of the heel groove 42.

The heel groove 42 is provided on the heel side with respect to the toe protruding portion 30. The heel groove 42 includes a portion located on the heel side with respect to the face center Fc. The heel groove 42 extends from a position located on the toe side with respect to the face center Fc to a position located on the heel side with respect to the face center Fc. The heel groove 42 is present at a position located on the lower side (at the position of the plane CP) of the face center Fc. The entirety of the heel groove 42 may be located on the heel side with respect to the face center Fc.

The vertical cross-sectional contour line of the outer surface of the heel groove 42 forms a recess. The heel groove 42 forms a recess on the outer surface 14*a* of the sole portion 14, and forms a projection on the inner surface of the sole portion 14. The heel groove 42 is easily deformed at impact. The rebound performance can be further improved by a combination of the toe protruding portion 30 and the heel groove 42. The portion in which the heel groove 42 is provided can be brought into contact with the ground surface at address. However, unlike a projection, the heel groove 42 does not impair the stability of the posture of the head at address.

The heel groove 42 has a back-side contour line (starting line) 44. A double-pointed arrow D2 in FIG. 11B shows a distance between the lower edge Fe of the striking face 10*a* and the contour line 44. The distance D2 is measured in the face-back direction. From the viewpoint of facilitating the deformation of the heel groove 42 to enhance the rebound performance, the distance D2 is preferably less than or equal to 30 mm, more preferably less than or equal to 28 mm, and still more preferably less than or equal to 25 mm at each position in the toe-heel direction. An excessively small distance D2 can cause a restriction on the manufacturing method of the head. From this viewpoint, the distance D2 is greater than or equal to preferably 10 mm, more preferably greater than or equal to 12 mm, and still more preferably greater than or equal to 14 mm.

The heel groove 42 has a face-side contour line (starting line) 46. A double-pointed arrow D3 in FIG. 11B shows a distance between the lower edge Fe of the striking face 10*a* and the contour line 46. The distance D3 is measured in the face-back direction. From the viewpoint of facilitating the deformation of the heel groove 42 to enhance the rebound performance, the distance D3 is preferably less than or equal to 20 mm, more preferably less than or equal to 18 mm, and still more preferably less than or equal to 15 mm at each position in the toe-heel direction. An excessively small distance D3 can cause a restriction on the manufacturing method of the head. From this viewpoint, the distance D3 is preferably greater than or equal to 6 mm, more preferably greater than or equal to 8 mm, and still more preferably greater than or equal to 10 mm.

Regarding the above-described embodiments, the following clauses are disclosed.

[Clause 1]

A golf club head including:

a face portion that forms a striking face;

a crown portion;

a sole portion; and a hosel portion, wherein the striking face has a face center, the sole portion includes a toe protruding portion that is a protruding portion formed on a toe side with respect to the face center and is hollow, the toe protruding portion is not present on a heel side with respect to the face center, and the toe protruding portion is formed so as to be continuous with the face portion.

[Clause 2]

The golf club head according to clause 1, wherein a height of an apex of the toe protruding portion is greater than or equal to 1.5 mm and less than or equal to 8 mm.

[Clause 3]

The golf club head according to clause 1 or 2, wherein the toe protruding portion is provided in a region that extends from a lower edge of the striking face to a position having a distance from the lower edge toward a back side of less than or equal to 25 mm.

[Clause 4]

The golf club head according to any one of clauses 1 to 3, wherein a minimum radius of curvature of a cross-sectional contour line of an outer surface of the toe protruding portion is less than or equal to 10 mm.

[Clause 5]

The golf club head according to any one of clauses 1 to 4, wherein the sole portion further includes a heel groove that is formed on the heel side with respect to the toe protruding portion, and the heel groove includes a portion that is located on the heel side with respect to the face center.

[Clause 6]

The golf club head according to any one of clauses 1 to 5, wherein the toe protruding portion extends, on its toe side, to reach a position located on an upper side with respect to the face center, and the toe protruding portion does not form any part of an outer contour line of the golf club head in a planer view of the golf club head which is in a reference state.

LIST OF REFERENCE NUMERALS

2 Golf club
4, 40 Head
6 Shaft
8 Grip
Face portion
10*a* Striking face
12 Crown portion
12*a* Crown outer surface
14 Sole portion
14*a* Sole outer surface
14*d* Sole base surface
30 Toe protruding portion
32 Boundary line between the sole base surface and the toe protruding portion
42 Heel groove
L1 Virtually extended line of the sole base surface
L2 Virtually extended line of the striking face
Fe Outer edge of the striking face
Z Shaft axis line
CG Head center of gravity
SS Sweet spot The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising," "having," "including," and "containing" are to be construed as open-ended terms (i.e., meaning "including, but not limited to,") unless otherwise noted.

What is claimed is:

1. A golf club head comprising:

a face portion that forms a striking face;

a crown portion;

a sole portion; and a hosel portion, wherein the striking face has a face center, the sole portion includes a toe protruding portion that is a protruding portion formed on a toe side with respect to the face center and is hollow, the toe protruding portion is formed so as to be continuous with the face portion, no protruding portion formed to be continuous with the face portion is present on a heel side with respect to the face center, the toe protruding portion extends, on its toe side, to reach a position located on an upper side with respect to the face center, and in a planar view from an upper side wherein the golf club head is in a reference state, the toe protruding portion does not form any part of an outer contour line of the golf club head.

2. The golf club head according to claim 1, wherein a height of an apex of the toe protruding portion is greater than or equal to 1.5 mm and less than or equal to 8 mm.

3. The golf club head according to claim 1, wherein the toe protruding portion is provided in a region that extends from a lower edge of the striking face to a position having a distance from the lower edge toward a back side of less than or equal to 25 mm.

4. The golf club head according to claim 1, wherein a minimum radius of curvature of a cross-sectional contour line of an outer surface of the toe protruding portion is less than or equal to 10 mm.

5. The golf club head according to claim 1, wherein the sole portion further includes a heel groove that is formed on the heel side with respect to the toe protruding portion, and the heel groove includes a portion that is located on the heel side with respect to the face center.

6. The golf club head according to claim 1, wherein when a distance in a toe-heel direction between the face center and a toe-most point of the golf club head is denoted by Dt, and a distance that is 50% of the distance Dt is denoted by Dy, in a cross-sectional contour line shown in a cross section taken along a vertical plane located at a position separated by the distance Dy from the face center toward the toe side, a distance between a lower edge of the striking face and a back-side starting point of the toe protruding portion is greater than or equal to 8 mm and less than or equal to 25 mm.

7. The golf club head according to claim 1, wherein when, a distance in a toe-heel direction between the face center and a toe-most point of the golf club head is denoted by Dt, a distance that is 50% of the distance Dt is denoted by Dy, and in a cross-sectional contour line shown in a cross section taken along a vertical plane located at a position separated by the distance Dy from the face center toward the toe side, a straight line or a circle that passes through following three points: a back-side starting point P1 of the toe protruding portion; a point P2 0.5 mm apart from the back-side starting point P1 toward the back side; and a point P3 0.5 mm apart from the point P2 toward the back side, is defined as a virtually extended line, then a maximum value of a height of the toe protruding portion measured from the virtually extended line is greater than or equal to 1.5 mm and less than or equal to 8 mm.

8. The golf club head according to claim 1, wherein when a distance in a toe-heel direction between the face center and a toe-most point of the golf club head is denoted by Dt, and a distance that is 50% of the distance Dt is denoted by Dy, in a cross-sectional contour line shown in a cross section taken along a vertical plane located at a position separated by the distance Dy from the face center toward the toe side, a portion extending from a back-side starting point of the toe protruding portion to an outer edge of the striking face is smooth and continuous.

9. The golf club head according to claim 1, wherein when a distance in a toe-heel direction between the face center and a toe-most point of the golf club head is denoted by Dt, and a distance that is 50% of the distance Dt is denoted by Dy, in a cross-sectional contour line shown in a cross section taken along a vertical plane located at a position separated by the distance Dy from the face center toward the toe side, the toe protruding portion and the striking face are made continuous with each other by a curved line that is convex toward an outside of the golf club head, and the curved line has a radius of curvature of greater than or equal to 7 mm and less than or equal to 25 mm.

10. The golf club head according to claim 1, wherein when a distance in a toe-heel direction between a heel-side end of the toe protruding portion and the face center is denoted by W1, and a width of the golf club head in the toe-heel direction is denoted by W2, W1/W2 is greater than or equal to 0.05 and less than or equal to 0.35.

11. The golf club head according to claim 1, wherein when a distance in an up-down direction between a ground plane of the golf club head and a toe-side end of the toe protruding portion is denoted by W3, and a width of the golf club head in the up-down direction is denoted by W4, W3/W4 is greater than or equal to 0.60 and less than or equal to 0.95.

12. The golf club head according to claim 1, wherein the toe protruding portion and the striking face are made continuous with each other by a convex curved surface region that is a curved surface convex toward an outside of the golf club head, when, a distance in a toe-heel direction between the face center and a toe-most point of the golf club head is denoted by Dt, a distance that is 50% of the distance Dt is denoted by Dy, and in a cross-sectional contour line shown in a cross section taken along a vertical plane located at a position separated by the distance Dy from the face center toward the toe side, a straight line or a circle that passes through following three points: a back-side starting point P1 of the toe protruding portion; a point P2 0.5 mm apart from the back-side starting point P1 toward the back side; and a point P3 0.5 mm apart from the point P2 toward the back side, is defined as a virtually extended line, then the virtually extended line intersects the convex curved surface region.

13. A golf club head comprising:

a face portion that forms a striking face;

a crown portion;

a sole portion; and a hosel portion, wherein the striking face has a face center, the sole portion includes a toe protruding portion that is a protruding portion formed on a toe side with respect to the face center and is hollow, the toe protruding portion is formed so as to be continuous with the face portion, the toe protruding portion extends, on its toe side, to reach a position located on an upper side with respect to the face center, and in a planar view from an upper side wherein the golf club head is in a reference state, the toe protruding portion does not form any part of an outer contour line of the golf club head.

14. A golf club head comprising:

a face portion that forms a striking face;

a crown portion;

a sole portion; and a hosel portion, wherein the striking face has a face center, the sole portion includes a toe protruding portion that is a protruding portion formed on a toe side with respect to the face center and is hollow, the toe protruding portion is formed so as to be continuous with the face portion, when a distance in a toe-heel direction between the face center and a toe-most point of the golf club head is denoted by Dt, and a distance that is 50% of the distance Dt is denoted by Dy, in a cross-sectional contour line shown in a cross section taken along a vertical plane located at a position separated by the distance Dy from the face center toward the toe side, a minimum radius of curvature of an outer surface of the toe protruding portion is less than or equal to 12 mm, the toe protruding portion extends, on its toe side, to reach a position located on an upper side with respect to the face center, and in a planar view from an upper side wherein the golf club head is in a reference state, the toe protruding portion does not form any part of an outer contour line of the golf club head.

* * * * *